United States Patent [19]

Tobias

[11] Patent Number: 4,517,993

[45] Date of Patent: May 21, 1985

[54] PIPE RACK

[76] Inventor: John D. Tobias, 233 E. Bloomfield, Royal Oak, Mich. 48073

[21] Appl. No.: 417,792

[22] Filed: Sep. 13, 1982

[51] Int. Cl.[3] ..... A24F 9/14

[52] U.S. Cl. ..... 131/329; 131/257; 131/260

[58] Field of Search ..... 131/329, 260, 257; D27/6

[56] References Cited

FOREIGN PATENT DOCUMENTS 460998 2/1937 United Kingdom ..... 131/329

*Primary Examiner*—V. Millin

*Attorney, Agent, or Firm*—Krass & Young

[57] ABSTRACT

The pipe rack is constructed so that the pipes are held upside down with the stems extending downwardly in a vertical direction. A base containing fibrous material therein is adapted to receive the mouthpiece of the pipe stem, with the fibrous material providing a wicking action to remove accumulated moisture from the pipe.

8 Claims, 6 Drawing Figures

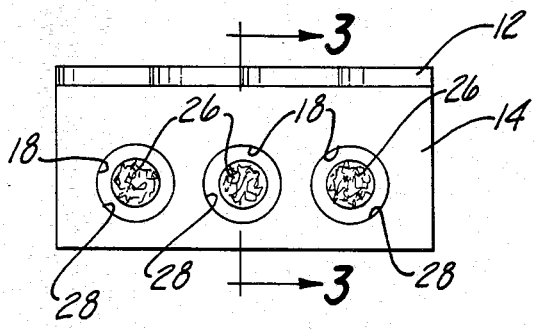
Fig-2
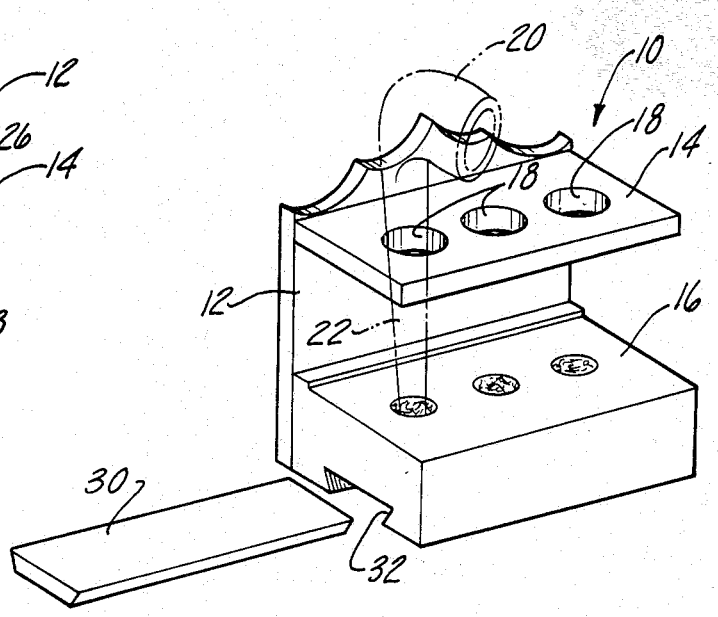
Fig-1
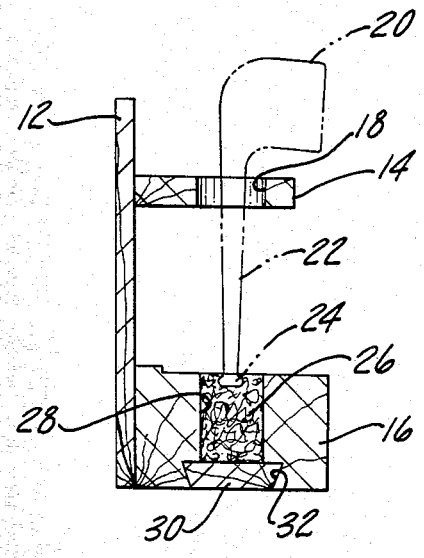
Fig-3
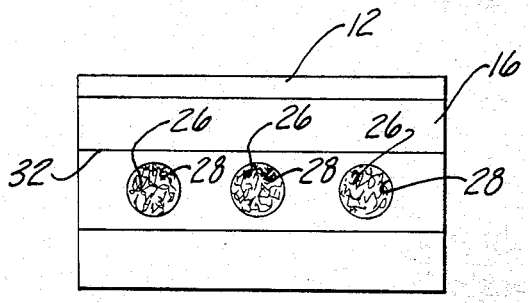
Fig-4
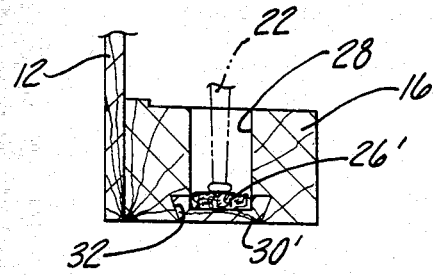
Fig-6
Fig-5
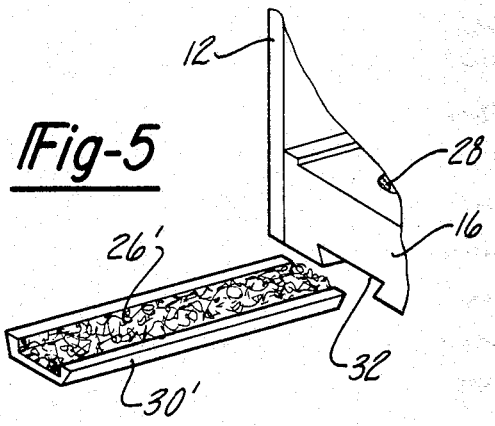

PIPE RACK

DESCRIPTION

REFERENCE TO DISCLOSURE DOCUMENT

The conception of this invention is evidenced by Disclosure Document No. 106845 entitled "Wick-Dry Pipe Rack", received Mar. 12, 1982.

TECHNICAL FIELD

This invention relates to smoking apparatus and, more particularly, to pipe racks.

BACKGROUND ART

The pleasure of pipe smoking has been experienced by many people over the years. Unfortunately, pipe smokers have often encountered the problem associated with collected moisture in the pipe stem that accumulates through usage. This moisture, or sludge as it is often referred to, which accumulates in the pipe collects and retains combustion bi-products of burning tobacco, such as tars and nicotine, making a distasteful solution. When this solution accumulates in the pipe stem to a certain level (depending on the curvature of the pipe) it can be inadvertently drawn into the smoker's mouth when drawing on the pipe, much to the displeasure of the smoker.

More seasoned pipe smokers combat this problem by the frequent use of pipe cleaners and associated devices to remove the moisture. Some pipes even include filters in the stem to collect the moisture. The use of filters, pipe cleaners, and other techniques for solving this age old problem tend to be time consuming and bothersome to the smoker. As a consequence, some accumulated moisture is almost always left in the pipe.

Existing commercially available pipe racks typically hold the pipes "bowl side down", allowing the accumulated moisture to settle into the bowl. The sludge in the bowl may have a tendency to be absorbed into the briar thereby affecting smoking quality as well as contaminating unsmoked tobacco and clogging the passageways in the pipe.

SUMMARY OF THE INVENTION

The present invention provides a simple solution to the problem of moisture accumulation in the pipe. The invention contemplates the use of a pipe rack having a means for holding at least one pipe so that its mouthpiece extends downwardly instead of upwardly as in conventional pipe racks. The pipe rack is designed to contain fibrous material for receiving the mouthpiece. Gravity pulls the accumulated sludge in the pipe stem towards the mouthpiece. The moisture that is drained by gravity towards the mouthpiece is absorbed by the fibrous material. The drying action of the pipe rack is further enhanced by the wicking action of the fibers or filaments in the material at the mouthpiece opening which draws moisture out of the pipe stem once gravity has caused the solution to contact the fibrous, absorbent material.

BRIEF DESCRIPTION OF THE DRAWINGS

These and other advantages of the present invention will become apparent to one skilled in the art upon reading the following specification, and by reference of the drawings by which:

FIG. 1 is a perspective view of a pipe rack made in accordance with the teachings of this invention;

FIG. 2 is a top plan view of the pipe rack of FIG. 1;

FIG. 3 is a cross-sectional view along the lines 3—3 of FIG. 2;

FIG. 4 is a bottom view of portions of the pipe rack of FIG. 1 with the bottom cover removed;

FIG. 5 is a partial perspective view of an alternative embodiment illustrating another method of holding the fibrous material in the pipe rack; and FIG. 6 is a partial cross-sectional view of the embodiment of FIG. 5.

DESCRIPTION OF THE PREFERRED EMBODIMENT

It should be noted from the outset that while this invention will be described in connection with particular examples employing its teaching, various modifications will become apparent to those skilled in the art.

The drawings illustrate a pipe rack 10 utilizing the teachings of this invention. Pipe rack 10 employs a vertically extending member 12 to which horizontally extending bracket 14 and base 16 are connected. Bracket 14 includes a plurality of holes 18 adapted to receive pipe stems. Pursuant to the present invention, the pipes (such as pipe 20 shown in phantom lines) are held by bracket 14 in a mouthpiece down position with the stem 22 extending generally downwardly in a substantially vertical direction.

The pipe mouthpiece 24 is adapted to come into contact with fibrous material 26 contained within base 16. In the embodiment of FIGS. 1–4, the fibrous material 26 is located within the chambers 28. Chambers 28 are defined by vertically extending bores which are vertically aligned with and have a slightly smaller diameter than bracket holes 18. The bottom of chambers 28 is closed off by way of a plate 30 having inclined edges slideably received by conforming edges in a track 32 in the lower surface of base 16. This construction enables the user to replace the fibrous materal 26 easily by sliding out plate 30 and pushing the material 26 out the bottom of base 16. New fibrous material 26 may be then inserted into chambers 28 and the plate 30 slid back in place. In the embodiment of FIGS. 5 and 6, the plate 30' takes the form of a tray for receiving a strip 26' of the fibrous material spanning all of the mouthpiece receiving chambers 28.

Various other modifications of the construction of the pipe rack 10 will become apparent to those skilled in the art. The broad teachings of this invention encompass various pipe rack constructions in which the pipe is held mouthpiece down in contact with the fibrous material. The fibrous material is preferably made of a plurality of thin, absorbent fibers or filaments capable of providing a wicking action for carrying moisture along the filaments an appreciable distance from the original point of contact with the moisture. Loosely packed balls of cotton have provided excellent results, but other suitable materials can also be used.

In use, the pipes 20 are placed into the pipe rack 10 mouthpiece side down in contact with the fibrous material 26. The accumulated moisture in the pipe falls by gravity to the opening in the mouthpiece where it is absorbed by the fibrous material. The drying action of the pipes are further increased by the wicking action of the fibrous material by drawing out the moisture into the bulk of the material once the moisture has contacted the filaments in the fibrous material. As a consequence of this action, the mouthpiece is not contaminated by the solution and the fibrous material may be used for an extended period of time before it is necessary to replace it.

Various modifications will become apparent to those skilled in the art upon reading the specification, drawings and the following claims.

I claim:

1. A pipe rack comprising:

a vertically extending member;

a generally horizontally extending bracket connected at one end to said member and having a plurality of holes therein for receiving pipe stems oriented such that their associated mouthpieces extend downwardly;

a generally horizontally extending base connected to lower portions of the member, said base having a plurality of chambers therein in vertical alignment with the holes in the bracket for receiving the mouthpieces of the pipes;

fibrous material made of loosely packed cotton filaments located within the chambers adapted to come into contact with the mouthpieces of the pipes; and a plate slideably engaged in a track in lower portions of the base serving as a removable cover for the lower portions of the chambers.

2. A pipe rack comprising:

A. a horizontally disposed bracket plate having at least one vertically extending through hole therein of a size to pass the stem of a pipe but block passage of the bowl of a pipe;

B. a horizontally disposed base member underlying said bracket plate with its upper surface spaced below the under surface of said bracket plate;

C. cavity means in said base member opening in said upper surface thereof and lying directly under said at least one hole in said bracket plate; and D. fibrous material positioned in said base member in association with said cavity means, whereby a pipe may be passed stem first downwardly through said at least one hole to position the mouthpiece of the pipe adjacent said cavity means and on said fibrous material to allow moisture in the pipe to drain down into and be absorbed by said fibrous material.

3. A pipe rack according to claim 2 wherein:

E. there are a plurality of vertically extending through holes in said bracket plate.

4. A pipe rack according to claim 3 wherein:

F. said cavity means comprises a plurality of vertically extending bores formed in said base member in respective vertical alignment with said holes in said bracket plate and opening in said upper surface of said base member.

5. A pipe rack according to claim 4 wherein said rack further includes:

G. a plate slidably engaged in a track in the underside of said base member and removably blocking the lower ends of said base member bores.

6. A pipe rack according to claim 5 wherein:

H. said fibrous material comprises individual masses of fibrous material positioned in each base member bore and removable therefrom for replacement by removal of said slidable plate and downward displacement of the fibrous masses.

7. A pipe rack according to claim 5 wherein:

H. said slidable plate is in the form of a continuous elongated tray; and

I. said fibrous material is positioned in said tray to underlie each of said base member bores.

8. A pipe rack according to claim 5 wherein:

H. said rack further includes a vertically oriented back plate;

H. said bracket plate is secured along one lengthwise edge thereof to one side face of said back plate generally adjacent the upper edge portion of said back plate and extends horizontally outwardly from said one side face in cantilever fashion;

I. said base member is secured along one lengthwise edge thereof to said one side face of said back plate adjacent the lower edge of said back plate and extends horizontally outwardly from said one side face in cantilever fashion;

J. said holes in said bracket plate are provided at longitudinally spaced locations therealong; and K. said bores in said base member are provided at longitudinally spaced locations therealong respectively vertically aligned with said bracket plate holes.

* * * * *